United States Patent [19]

Mignot

[11] 4,386,156

[45] May 31, 1983

[54] SILVER BROMIDE EMULSIONS OF NARROW GRAIN SIZE DISTRIBUTION AND PROCESSES FOR THEIR PREPARATION

[75] Inventor: Andre G. E. Mignot, Bonneuil-sur-Marne, France

[73] Assignee: Eastman Kodak Company, Rochester, N.Y.

[21] Appl. No.: 320,912

[22] Filed: Nov. 12, 1981

[51] Int. Cl.[3] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 3,650,757 | 3/1972 | Irie et al. | 430/567 |
| 4,063,951 | 12/1977 | Bogg | 430/567 |
| 4,264,724 | 4/1981 | Moisar et al. | 430/567 |
| 4,284,717 | 8/1981 | Toya et al. | 430/569 |

FOREIGN PATENT DOCUMENTS

| | | | |
|---|---|---|---|
| 1335925 | 10/1973 | United Kingdom | 430/567 |

OTHER PUBLICATIONS

A. Mignot, E. Francois, and M. Catinat, "Flat Untwinned Silver Bromide Crystals Limited by (100) Faces," *Journal of Crystal Growth,* vol. 23, (1974), pp. 207–213.

Evans et al., "Further Contribution to the Theory of Photographic Sensitivity," *Journal of Photo. Science,* vol. 3, 1955, pp. 73–87.

Hamilton, "Twinning in Tabular Photographic Grains," *Journal of Appld. Physics,* vol. 29, No. 6, Jun. 1958, p. 994.

Farnell et al., "A Technique for Examination of the Edge Faces of Tabular Microcrystals Applied to Silver-Bromide Grains for Evidence of Twinning," *Journal of Photo. Science,* vol. 9, 1961, pp. 67–69.

Chem. Abstracts, vol. 60, 8817a.

Duffin, Photographic Emulsion Chemistry, pp. 66–72.

Trivelli et al., "Effect of Silver Iodide upon the Structure of Silver Bromo-Iodide Precipitation Series," *Photo. Journal,* Jul. 1940, pp. 285–288.

Peelaers et al., "Decoration of the Surface of Silverbromide Microcrystals by Treatment with Dithiosulfatoaurate (I) Ions," *Photo Korr* 105(5), pp. 77–82, (1969).

de Cugnac et al., "Evolution of the Morphology of Silver Bromide Crystals During Physical Ripening," *Science et Industries Photographiques,* vol. 33, No. 2, 1962, pp. 121–125.

Klein et al., "Ia: Properties of Photographic Emulsion Grains," *Journal of Photo. Science,* vol. 12, 1964, pp. 242–251.

Hirata et al., "Growth Mechanism of Monodisperse AgBr Microcrystals in Gelatin Solution," *Bull. Soc. Sci. Photo Japan,* No. 16, 1966, pp. 1–7.

*Primary Examiner*—Mary F. Downey

*Attorney, Agent, or Firm*—Carl O. Thomas

[57] ABSTRACT

Radiation-sensitive emulsions are disclosed containing tabular silver bromide grains bounded by two substantially parallel square or rectangular crystal faces and having an average aspect ratio of at least 8.5:1. The tabular grains preferably exhibit a coefficient of variation of less than 30. The tabular grains are formed by providing cubic seed grains having an edge length of less than 0.15 micron and ripening the seed grains at a pAg in the range of from 5.0 to 8.0 in the substantial absence of non-halide silver ion complexing agents.

20 Claims, 3 Drawing Figures

SILVER BROMIDE EMULSIONS OF NARROW GRAIN SIZE DISTRIBUTION AND PROCESSES FOR THEIR PREPARATION

FIELD OF THE INVENTION

The invention relates to photography. It is more specifically directed to silver halide emulsions and photographic elements and to processes for their preparation.

BACKGROUND OF THE INVENTION

Radiation-sensitive emulsions employed in photography are comprised of a dispersing medium, typically gelatin, containing embedded micro-crystals—known as grains—of radiation-sensitive silver halide. A great variety of both regular and irregular grain shapes have been observed in silver halide photographic emulsions. Regular grains are often cubic or octahedral in shape. Grain edges may exhibit rounding due to ripening effects, and in the presence of strong ripening agents, such as ammonia, the grains may even be spherical. Rods and tabular grains in varied proportions have been frequently observed mixed in among other grain shapes, particularly where the pAg (the negative logarithm of silver ion activity) of the emulsions has been varied during precipitation, as occurs, for example, in single jet precipitations. Tabular grains are those areally extended in two dimensions as compared to their thickness. In their most commonly observed form tabular grains have two opposed triangular or hexagonal major faces and appear to be bounded by (111) crystal faces.

A. Mignot, E. Francois, and M. Catinat, "Flat Untwinned Silver Bromide Crystals Limited by (100) Faces," *Journal of Crystal Growth,* Vol. 23, (1974), pp. 207–213, report the observation of tabular silver bromide crystals having square or rectangular major faces. The crystals appear to be bounded by (100) crystal faces. These tabular grains were present in emulsions predominantly containing other grain configurations.

Bogg U.S. Pat. No. 4,063,951 discloses a technique for preparing tabular silver halide emulsions containing tabular grains bounded by (100) crystal faces. The tabular grains have two opposed, substantially parallel major faces which are square or rectangular. The tabular grains are prepared from monodisperse seed grains. Upon Ostwald ripening in the presence of ammonia, a known ripening agent, and alkali halide tabular grains are formed having an average aspect ratio in the range of from 1.5 to 7:1. Aspect ratio is the ratio of grain edge length to thickness. From FIG. 4 of Bogg, the coefficient of variations appears to be at least 50.

Wilgus and Haefner U.S. Ser. No. 320,905, filed concurrently herewith and commonly assigned, titled HIGH ASPECT RATIO SILVER BROMOIODIDE EMULSIONS AND PROCESSES FOR THEIR PREPARATION, now abandoned in favor of continuation-in-part U.S. Ser. No. 429,420, filed Sept. 30, 1982, discloses high aspect ratio silver bromoiodide emulsions and a process for their preparation.

Kofron et al. U.S. Ser. No. 320,904, filed concurrently herewith and commonly assigned, titled SENSITIZED HIGH ASPECT RATIO SILVER HALIDE EMULSIONS AND PHOTOGRAPHIC ELEMENTS, now abandoned in favor of continuation-in-part U.S. Ser. No. 429,407, filed Sept. 30, 1982, discloses chemically and spectrally sensitized high aspect ratio tabular grain silver halide emulsions and photographic elements incorporating these emulsions.

Daubendiek and Strong U.S. Ser. No. 320,906, filed concurrently herewith and commonly assigned, titled AN IMPROVED PROCESS FOR THE PREPARATION OF HIGH ASPECT RATIO SILVER BROMOIODIDE EMULSIONS, now abandoned in favor of continuation-in-part U.S. Ser. No. 429,587, filed Sept. 30, 1982, discloses an improvement on the processes of Maternaghan whereby high aspect ratio tabular grain silver bromoiodide emulsions can be prepared.

Abbott and Jones U.S. Ser. No. 320,907, filed concurrently herewith and commonly assigned, titled RADIOGRAPHIC ELEMENTS EXHIBITING REDUCED CROSSOVER, now abandoned in favor of continuation-in-part U.S. Ser. No. 430,222, filed Sept. 30, 1982, discloses the use of high aspect ratio tabular grain silver halide emulsions in radiographic elements coated on both major surfaces of a radiation transmitting support to control crossover.

Wey U.S. Ser. No. 320,908, filed concurrently herewith and commonly assigned, titled IMPROVED DOUBLE-JET PRECIPITATION PROCESSES AND PRODUCTS THEREOF, now abandoned in favor or continuation-in-part U.S. Ser. No. 429,403, filed Sept. 30, 1982, discloses a process of preparing tabular silver chloride grains which are substantially internally free of both silver bromide and silver iodide. The emulsions have an average aspect ratio of greater than 8:1.

Solberg, Piggin, and Wilgus U.S. Ser. No. 320,909, filed concurrently herewith and commonly assigned, titled RADIATION-SENSITIVE SILVER BROMOIODIDE EMULSIONS, PHOTOGRAPHIC ELEMENTS, AND PROCESSES FOR THEIR USE, now abandoned in favor of continuation-in-part U.S. Ser. No. 431,913, filed Sept. 30, 1982, discloses high aspect ratio tabular grain silver bromoioidide emulsions wherein a higher concentration of iodide is present in an annular region than in a central region of the tabular grains.

Dickerson U.S. Ser. No. 320,910, filed concurrently herewith and commonly assigned, titled FOREHARDENED PHOTOGRAPHIC ELEMENTS AND PROCESSES FOR THEIR USE, now abandoned in favor of continuation-in-part Ser. No. 430,574, filed Sept. 30, 1982, discloses producing silver images of high covering power by employing photographic elements containing forehardened high aspect ratio tabular grain silver halide emulsions.

SUMMARY OF THE INVENTION

In one aspect this invention is directed to a radiation-sensitive emulsion comprised of a dispersing medium and silver bromide grains, wherein tabular silver bromide grains bounded by two substantially parallel square or rectangular major crystal faces and having an average aspect ratio of at least 8.5:1 account for at least 50 percent of the total projected surface area of the silver bromide grains present in the emulsion.

In another aspect this invention is directed to a photographic element comprised of a support and at least one silver halide emulsion as described above.

In an additional aspect this invention is directed to a process of producing a silver bromide emulsion containing tabular silver bromide grains bounded by two substantially parallel square or rectangular major crystal faces comprising providing a monodisperse silver bromide emulsion containing cubic seed grains having an edge length of less than 0.15 micron and ripening the seed grains to produce tabular grains. The process is characterized by the improvement comprising, while maintaining the pAg of the seed grain emulsion in the range of from 5.0 to 8.0, ripening the emulsion in the substantial absence of nonhalide silver ion complexing agents to produce tabular silver bromide grains having an average aspect ratio of at least 8.5:1.

In a specific preferred form of the invention the tabular silver bromide grains have a coefficient of variation of less than 30.

Through the practice of the present invention it is now possible to obtain tabular grains having square or rectangular major faces of higher average aspect ratio than has heretofore been realized in the art. It is recognized in the art that increased covering power and other photographic advantages can be attributed to the comparatively high aspect ratios of tabular silver halide grains. The present invention, by allowing average aspect ratios of tabular grains having square or rectangular major faces to be further increased, allows enhancement of photographic characteristics known to be improved as a direct function of aspect ratio.

In a preferred form of the invention it is also possible to obtain a narrower grain size distribution than has been heretofore realizable for tabular silver bromide grains having square or rectangular major faces. The advantages of restricted grain size distributions are well known to the art. For example, it is known that contrast increases as grain size distribution is narrowed. Further, it is known that the surface to volume ratio of silver halide grains is directly related to their size. Thus, response of silver halide grains to surface treatments is less varied when narrower grain size distributions are in evidence. The present invention, by allowing narrower grain size distributions to be realized, also allows the realization of the known accompanying photographic advantages.

This invention can be better appreciated by reference to the following detailed description considered in conjunction with the drawings, in which FIG. 1A is a plot of number of grains as a percentage against grain size in microns; and FIGS. 1B and 2 are photomicrographs of emulsions according to the invention.

DESCRIPTION OF PREFERRED EMBODIMENTS

Figure 1A:
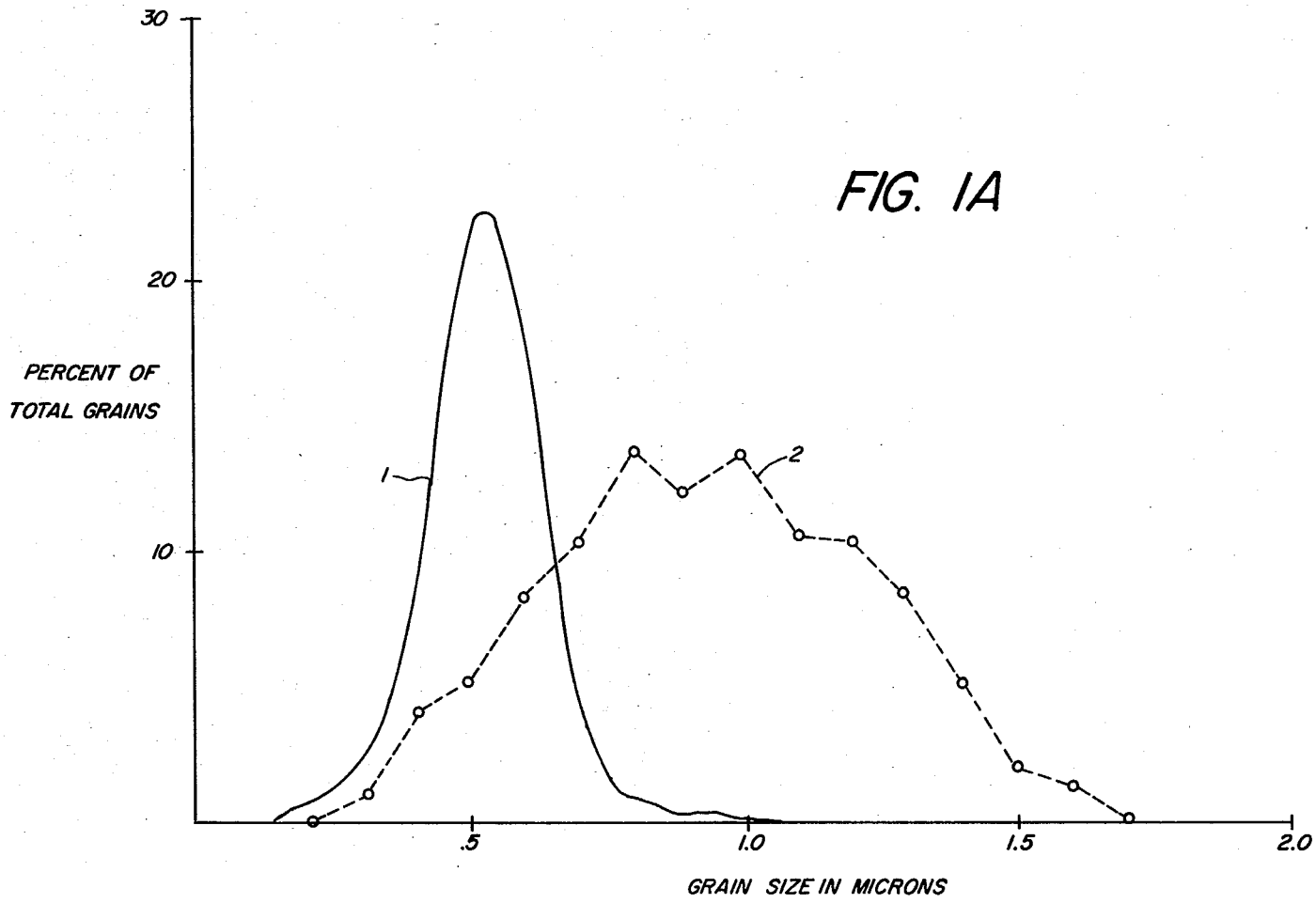

The radiation-sensitive emulsions of the present invention are comprised of a dispersing medium and tabular silver bromide grains having two opposed, substantially parallel faces which are square or rectangular. Preferred tabular grains can be further characterized as being bounded by (100) crystal faces. The tabular grains have an average aspect ratio of at least 8.5:1 and preferably greater than 10:1. As employed herein the term "aspect ratio" refers to the ratio of the average edge length of the grain to its thickness. The "average edge length" is in turn defined as the edge length of a square having an area equal to the projected area of the grain as viewed in a photomicrograph of an emulsion sample. Under optimum conditions of preparation aspect ratios of 30:1, 50:1, or even higher are contemplated.

As will be apparent, the thinner the grains, the higher their aspect ratio for a given edge length. Typically grains of desirable aspect ratios are those having a thickness less than 0.3 micron. The preferred tabular grains of this invention have a thickness of less than 0.2 micron. Typically, the tabular grains have a thickness of at least 0.05 micron, although still thinner grains can in principle be formed. The tabular silver bromide grains having a thickness of less than 0.3 micron account for at least 50 percent, preferably at least 70 percent, and optimally at least 90 percent, of the total projected surface area of the silver bromide grains present in the emulsion.

The grain characteristics described above of the silver bromide emulsions of this invention can be readily ascertained by procedures well known to those skilled in the art. From shadowed photomicrographs of emulsion samples it is possible to determine the thickness and edge length of each tabular grain. From this information the aspect ratio of each tabular grain can be calculated and averaged to obtain their average aspect ratio. The projected surface areas of the silver bromide grains can be summed, the projected surface areas of the remaining silver bromide grains, if any, in the photomicrograph can be summed separately, and from the two sums the percentage of the total projected surface area of the silver bromide grains provided by the square and rectangular tabular grains can be calculated.

Useful tabular grain emulsions according to the present invention can be formed by first preparing a monodisperse cubic seed grain silver bromide emulsion. As applied to emulsions herein, the term "monodisperse" indicates a coefficient of variation of less than 10 and preferably less than 5. (As employed herein the coefficient of variation is defined as the standard deviation of the edge lengths of squares equal in area to the area of each grain divided by the average grain edge length of the squares.) The edge length of the cubic seed grains should be less than the desired thickness of the tabular grains to be formed therefrom. Since some increase in tabular grain thickness beyond the initial edge length of the seed grains can occur and since a higher degree of monodispersity is more readily attained at finer grain sizes, it is preferred that a seed grain edge length of less than 0.15 micron be employed. In a specifically preferred form of the invention the seed grains have an edge length of less than 0.08 micron.

The formation of monodisperse cubic seed grain emulsions can be undertaken by any convenient conventional technique. For example, useful seed grain emulsions can be prepared by the techniques disclosed by Bogg U.S. Pat. No. 4,063,951, cited above. Preferred seed grain emulsions are prepared by a double-jet precipitation process in which a silver salt, such a silver nitrate, and one or more bromide salts, such a alkali metal (e.g., sodium or potassium) or alkaline earth metal (e.g., calcium or magnesium) bromide, are concurrently run into a reaction vessel. Conventional concentrations of the silver and bromide salts can be employed—e.g., from about 0.2 M up to saturation. Since more rapid and uniform mixing is required at higher concentration levels, it is preferred to employ concentrations of less than 4 molar, preferably less than 2 molar, and optimally less than 1 molar.

Prior to the concurrent addition of the silver and bromide salts at least a portion (typically 20 to 80 percent by weight) of the dispersing medium is run into the reaction vessel. Further, a small portion of bromide salt is run into the reaction vessel to adjust pAg to the desired level. The small silver ion concentration present before silver salt addition is provided by a silver electrode used to measure pAg. Apparatus and techniques for controlling pAg and pH during silver halide precipitation are disclosed by Oliver U.S. Pat. No. 3,031,304, Culhane et al U.S. Pat. No. 3,821,002, and Claes and Peelaers, *Photographic Korrespondez,* 103, 161 (1967).

During precipitation the pAg within the reaction vessel is controlled to favor the formation of cubic grains. To accomplish this the pAg is maintained on the halide side of the equivalence point (the pAg at which the concentration of silver and halide ions are stoichiometrically equal) and preferably within the pAg range of from 5 to 8. For silver bromide seed grains a preferred pAg range is from about 6.5 to 7.5. Seed grain precipitation temperatures, which also affect optimum pAg values, can range from about 20° C. up to the highest temperatures known to be useful in preparing emulsions of the desired grain size. Preferred precipitation temperatures are in the range of from about 35° to 70° C.

The pH is maintained on the acid side of neutrality during silver bromide precipitation. Generally a pH in the range of from 6.0 to 7.0 is adequate for this purpose. Nevertheless, to provide protection against ripening of the silver bromide grains during their formation, lowering the pH below 5.5 is specifically contemplated. For example, by maintaining the pH in the range of from about 2 to 4.5, a high degree of protection against ripening has been demonstrated. Both nitric and sulfuric acid are commonly employed in lowering pH during silver bromide precipitation. Alkali hydroxide is commonly used to raise pH. Although not essential, it is preferred that the silver and bromide salts be introduced into the reaction vessel in the shortest practical time to guard further against unwanted grain ripening. Acceleration of salt introduction rates in proportion to the increase in the surface area of the silver bromide grains as they increase in size can be undertaken, as is well understood in the art. It, of course, goes without saying that no silver bromide ripening agent (other than the excess bromide necessary to maintain pAg) should be intentionally added to the reaction vessel during silver bromide precipitation. That is, there is a substantial absence (less than 0.05 molar) of silver ion complexing agents, such as thiocyanate, thioether, or ammonia.

Following precipitation, the cubic seed grain emulsion is Ostwald ripened to produce tabular silver bromide grains according to this invention. The tabular silver bromide grains produced exhibit a higher aspect ratio and a lower coefficient of variation than those of Bogg by reason of employing a distinctly different ripening procedure. Whereas Bogg relies upon ammonia in a concentration of from 0.1 to 1 molar to produce tabular grains, the present invention is based on the discovery that the substantial absence (preferably total absence) of silver complexing agents (other than bromide) allows Ostwald ripening to produce superior tabular grains. This is accomplished by maintaining the pAg on the bromide side of the equivalence point during Ostwald ripening, preferably within a pAg range of from 5 to 8. It is believed that the excess of bromide ions complex with silver during Ostwald ripening. Although ripening occurs relatively slowly, the highest attainable aspect ratios can be achieved in less than an hour. Ripening rates are, of course affected by temperature. Ripening temperatures up to 80° C. are contemplated. Generally, if the temperature, pAg, or a combination of both are higher than those employed during precipitation, ripening is accelerated. It is preferred to employ temperatures in the range of from 50° to 70° C. In order for ripening to occur, it is necessary to increase the pH above 5.5. Ripening on the acid side of neutrality is contemplated, with a pH in the range of from 5.5 to 6.5 being preferred.

The preferred tabular grain emulsions of the invention are the direct product of the preparation process described above. The tabular grain emulsion as formed exhibits a relatively narrow size-frequency distribution. More precisely stated, the tabular grains exhibit a coefficient of variation of less than 30 and preferably less than 20. This is a relatively narrow size-frequency distribution for tabular grains, and it is a lower coefficient of variation than has heretofore been observed for tabular grains presenting square or rectangular projected areas. As formed, the tabular grains can also account for substantially the entire grain population of the emulsions of this invention.

It is well known to blend emulsions to tailor photographic characteristics for a specific application. For example, blending is commonly undertaken to adjust the shape of the characteristic curve provided by an emulsion layer of a photographic element. By blending tabular grain emulsions prepared according to this invention having differing grain sizes, it is possible to adjust maximum density and contrast, for example. In this case the emulsion still has a very high proportion of tabular grains, but has a higher coefficient of variation by reason of blending. If nontabular grains are employed for blending, the proportion of tabular grains will be reduced. Finally, if marginal preparation conditions are employed, rather than the preferred and optimum conditions described above, both the coefficient of variation and the proportion of nontabular grains are increased. The emulsions of the present invention can be generally characterized as those which contain at least 50 percent, preferably at least 70 percent, and optimally at least 90 percent, based on total silver bromide grain projected area, tabular silver bromide grains as described above, although by blending with other emulsions the proportion of tabular grains according to the invention may be further reduced in an actual photographic emulsion layer.

In addition to the inventive grain structures described above the radiation-sensitive emulsions and photographic elements of this invention employ conventional features, such as those of the paragraphs cited below of *Research Disclosure,* Vol. 176, December 1978, Item 17643, here incorporated by reference. (*Research Disclosure* and *Product Licensing Index* are publications of Industrial Opportunities Ltd.; Homewell, Havant; Hampshire, P09 1EF, United Kingdom.) For example, the dispersing medium can be selected from among conventional vehicles and extenders described in Paragraph IX. The vehicles can also be employed in other layers of the photographic elements. The vehicles can be hardened, as described in Paragraph X. The tabular grains can be blended, as described in Paragraph I, subparagraph F. The emulsions can be washed, as described in Paragraph II. The tabular grains can be chemically sensitized, as described in Paragraph III, and/or spectrally sensitized or desensitized, as described in Paragraph IV. The photographic elements can contain brighteners, antifoggants, stabilizers, scattering or absorbing materials, coating aids, plasticizers, lubricants, and matting agents, as described in Paragraphs V, VI, VIII, XI, XII, and XVI. Methods of addition and coating and drying procedures can be employed, as described in Paragraphs XIV and XV.

Conventional photographic supports can be employed, as described in Paragraph XVII. The photographic elements can be black-and-white or, preferably, color photographic elements which form silver images and/or dye images through the selective destruction, formation, or physical removal of dyes, as described in Paragraph VII. Specifically preferred color photographic elements according to this invention are those which form dye images through the use of color developing agents and dye-forming couplers. To put the photographic elements to use, they can be conventionally exposed, as described in Paragraph XVIII, and they can be conventionally processed, as described in Paragraph XIX.

EXAMPLES

The invention can be better appreciated by reference to the following specific examples:

EXAMPLE 1

A solution of 20 g of inert gelatin in 1000 ml of distilled water was prepared; the pH of this solution was adjusted at 6.0 and it was maintained at 40° C. In one minute, 50 ml of a silver nitrate 1 molar solution and 50 ml of a potassium bromide 1 molar solution were introduced in this gelatin solution by the double jet technique. At the end of the precipitation step, the pAg was 7.02 and the pH was 6.11 and the average edge length of the resulting cubic grains was 0.06 micron.

Physical ripening was then carried out while maintaining the emulsion for 1 hour at 60° C. During the whole ripening, the pAg level was maintained at 7.02 and the pH at 6.11. The resulting tabular grains have an average edge length of 0.52 micron and an average thickness of 0.06 micron. The average aspect ratio was 8.67:1.

Curve 1 in FIG. 1A shows the size-frequency distribution of the tabular emulsion prepared as described above. Curve 2 shows the size-frequency distribution of a tabular emulsion shown in FIG. 4 of Bogg U.S. Pat. No. 4,063,951. By comparing the curves it is apparent that the emulsion of the present invention exhibits a much narrower coefficient of variation than that of Bogg. Specifically, the coefficient of variation of the emulsion according to the invention is less than 20, whereas that of the emulsion of Bogg appears to be approximately 50.

Figure 1B:
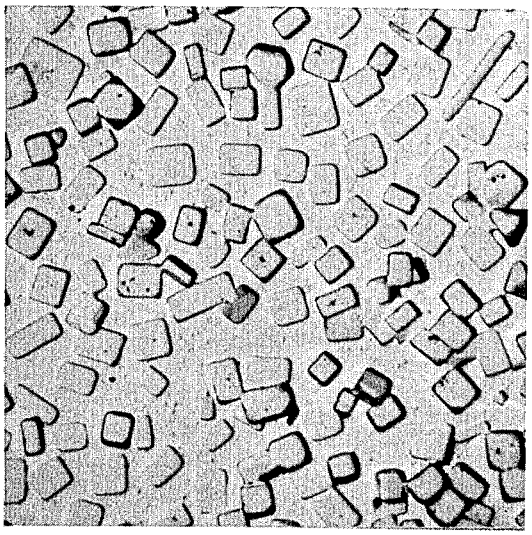

FIG. 1B is a photomicrograph of the emulsion prepared as described above. The grains are tabular having opposed square and rectangular major faces. The faces of the grains appear to lie in (100) crystal planes. Magnification is 10,000×.

EXAMPLE 2

Figure 2:
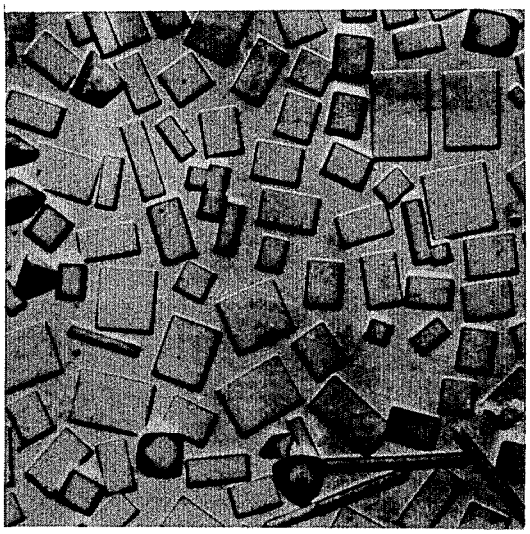

A solution of 60 g of inert gelatin in 3000 ml of distilled water was prepared. The pH of this solution was adjusted at 6.0 and the solution was maintained at 40° C. In 20 seconds, a silver nitrate 1 molar solution and a potassium bromide 1 molar solution were introduced in this gelatin solution by the double jet technique, the flow rate for each solution being 140 ml per minute. The pAg rose to 7.40 and it was lowered to 6.99 by adding silver nitrate. The pH at the end of precipitation was 6.03. Physical ripening was then carried out in the same conditions as in Example 1. FIG. 2 represents a photomicrograph (magnification 10,000×) of the tabular grains obtained. The average length of the edge of the tabular grains is 0.7 micron, the average thickness is 0.06 micron, and their average aspect ratio is greater than 11:1.

EXAMPLE 3

A solution of 60 g of inert gelatin in 3000 ml of distilled water was prepared. The solution was maintained at 40° C. The pH was adjusted to 3.01 by adding nitric acid.

The procedure of Example 2 was repeated to precipitate the seed crystals. At the end of the precipitation step, the pH was 3.02; the pAg was lowered from 7.54 to 6.63 by adding silver nitrate. The pH of the emulsion was adjusted to 5.97 and physical ripening was then carried out by heating for 1 hour at 75° C. After one hour of physical ripening, there remained small size crystals. After one hour of additional ripening in the same conditions, the small size crystals had disappeared and an emulsion was obtained which was comprised of tabular grains having a narrow size distribution, an average edge length of 1.25 micron, and average thicknesses of 0.06 micron. The average aspect ratio was greater than 20.1.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver bromide grains, wherein tabular silver bromide grains bounded by two substantially parallel square or rectangular major crystal faces and having an average aspect ratio of at least 8.5:1 account for at least 50 percent of the total projected surface area of the silver bromide grains present in the emulsion.

2. A radiation-sensitive emulsion according to claim 1 wherein said tabular silver bromide grains exhibit a coefficient of variation of less than 30.

3. A radiation-sensitive emulsion according to claim 1 wherein said tabular silver bromide grains exhibit a thickness of less than 0.3 micron.

4. A radiation-sensitive emulsion according to claim 1 in which said tabular silver bromide grains exhibit an average aspect ratio of greater than 10:1.

5. A radiation-sensitive emulsion according to claim 1 wherein said tabular silver bromide grains account for at least 70 percent of the total projected surface area of the silver bromide grains present in the emulsion.

6. A radiation-sensitive emulsion according to claim 1 wherein said tabular silver bromide grains account for at least 90 percent of the total projected surface area of the silver bromide grains present in the emulsion.

7. A radiation-sensitive emulsion comprised of a dispersing medium and silver bromide grains, wherein tabular silver bromide grains having a thickness of less than 0.3 micron bounded by (100) crystallographic planes and having two substantially parallel square or rectangular major crystal faces have an average aspect ratio of greater than 10:1, account for at least 70 percent of the projected surface area of the silver bromide grains, and exhibit a coefficient of variation of less than 20.

8. A radiation-sensitive emulsion comprised of a dispersing medium and silver bromide grains, wherein tabular silver bromide grains having a thickness of less than 0.2 micron bounded by (100) crystallographic planes and having two substantially parallel square or rectangular major crystal faces have an average aspect ratio of greater than 10:1, account for at least 90 percent of the projected surface area of the silver bromide grains, and exhibit a coefficient of variation of less than 20.

9. A radiation-sensitive emulsion according to claim 8 wherein said tabular silver bromide grains consist essentially of silver bromide as the sole silver halide present.

10. In a photographic element comprised of a support and, located on said support, at least one silver halide emulsion layer, the improvement comprising said silver halide emulsion layer comprising an emulsion according to claim 1, 2, 3, 4, 5, 6, 7, 8, or 9.

11. In a process of producing a silver bromide emulsion containing tabular silver bromide grains bounded by two substantially parallel square or rectangular major crystal faces comprising providing a monodisperse silver bromide emulsion containing cubic seed grains having an edge length of less than 0.15 micron and ripening the seed grains to produce tabular grains, the improvement comprising while maintaining the pAg of the seed grain emulsion in the range of from 5.0 to 8.0, ripening the emulsion in the substantial absence of nonhalide silver ion complexing agents to produce tabular silver bromide grains having an average aspect ratio of at least 8.5:1.

12. A process according to claim 11 wherein the seed grains have an edge length of less than 0.08 micron.

13. A process according to claim 11 wherein ripening is conducted at a pH in the range of from 5.5 to 7.0.

14. A process according to claim 11 wherein ripening is conducted at a temperature in the range of from 50° to 80° C.

15. A process according to claim 11, 12, 13, or 14 wherein the seed grains are produced by a double-jet precipitation reaction of an aqueous silver salt solution and an aqueous alkali halide salt solution at a pAg in the range of from 5.0 to 8.0.

16. A process according to claim 15 wherein said aqueous salt solutions are of less than 2 molar concentration.

17. A process according to claim 16 wherein said aqueous salt solutions are of less than 1 molar concentration.

18. A process according to claim 15 wherein the double-jet precipitation is undertaken at a temperature of greater than 20° C.

19. A process according to claim 15 wherein the double-jet precipitation is undertaken at a pH in the range of from 2.0 to 4.5.

20. In a process of producing a silver bromide emulsion comprised of a dispersing medium and tabular grains bounded by (100) crystal faces comprising providing a monodisperse emulsion containing cubic seed grains and ripening the seed grains to produce tabular grains the improvement comprising precipitating at a pAg of from 6.5 to 7.5, a pH of from 2.0 to 4.5, and a temperature of greater than 20° C. a monodisperse silver bromide emulsion comprised of a dispersing medium and cubic seed grains having an average edge length of less than 0.08 micron, and while maintaining the seed grain emulsion at a pAg in the range of from 6.5 to 7.5, a pH in the range of 6.0 to 7.0, and a temperature of from 50° to 70° C., ripening the seed grain emulsion in the absence of silver ion complexing agents other than bromide to produce tabular silver bromide grains having an average aspect ratio of at least 10:1 and a coefficient of variation of less than 20.

* * * * *